United States Patent [19]

Donnelly, Jr.

[11] Patent Number: 4,607,169

[45] Date of Patent: Aug. 19, 1986

[54] ARTESIAN WELL GENERATED POWER SYSTEM

[76] Inventor: Joseph R. Donnelly, Jr., 22 Mariner Cir., West Islip, N.Y. 11795

[21] Appl. No.: 688,523

[22] Filed: Jan. 3, 1985

[51] Int. Cl.[4] ..... F03B 13/00; F03B 13/105

[52] U.S. Cl. ..... 290/54; 62/260; 165/48.1; 237/12.1

[58] Field of Search ..... 290/43, 52, 54; 62/260; 165/45, 48.1, 48.2; 237/12.1; 219/279

[56] References Cited

U.S. PATENT DOCUMENTS

| | | | |
|---|---|---|---|
| 818,204 | 4/1906 | Teilman | 290/52 |
| 3,538,340 | 11/1970 | Lang | 290/52 |
| 3,590,910 | 7/1971 | Lorenz | 165/48.1 X |
| 3,803,422 | 4/1974 | Krickler | 290/52 |
| 3,939,356 | 2/1976 | Loana | 290/52 |
| 4,134,024 | 1/1976 | Wiseman | 290/52 |
| 4,142,367 | 3/1979 | Guisti | 290/54 X |
| 4,375,831 | 3/1983 | Downing, Jr. | 62/260 X |
| 4,392,062 | 7/1983 | Bervig | 290/54 |

*Primary Examiner*—L. T. Hix
*Assistant Examiner*—Brian W. Brown
*Attorney, Agent, or Firm*—Leonard Belkin

[57] ABSTRACT

An electric power generating system utilizing water from an artesian well for continuously supplying electricity. Excess electric power not required during periods of low power requirements is fed into the outside source of electric power which is relied upon during peak periods of power usage. During those times when cooling is required, the artesian well water is fed continuously through convectors to effect such cooling.

3 Claims, 1 Drawing Figure

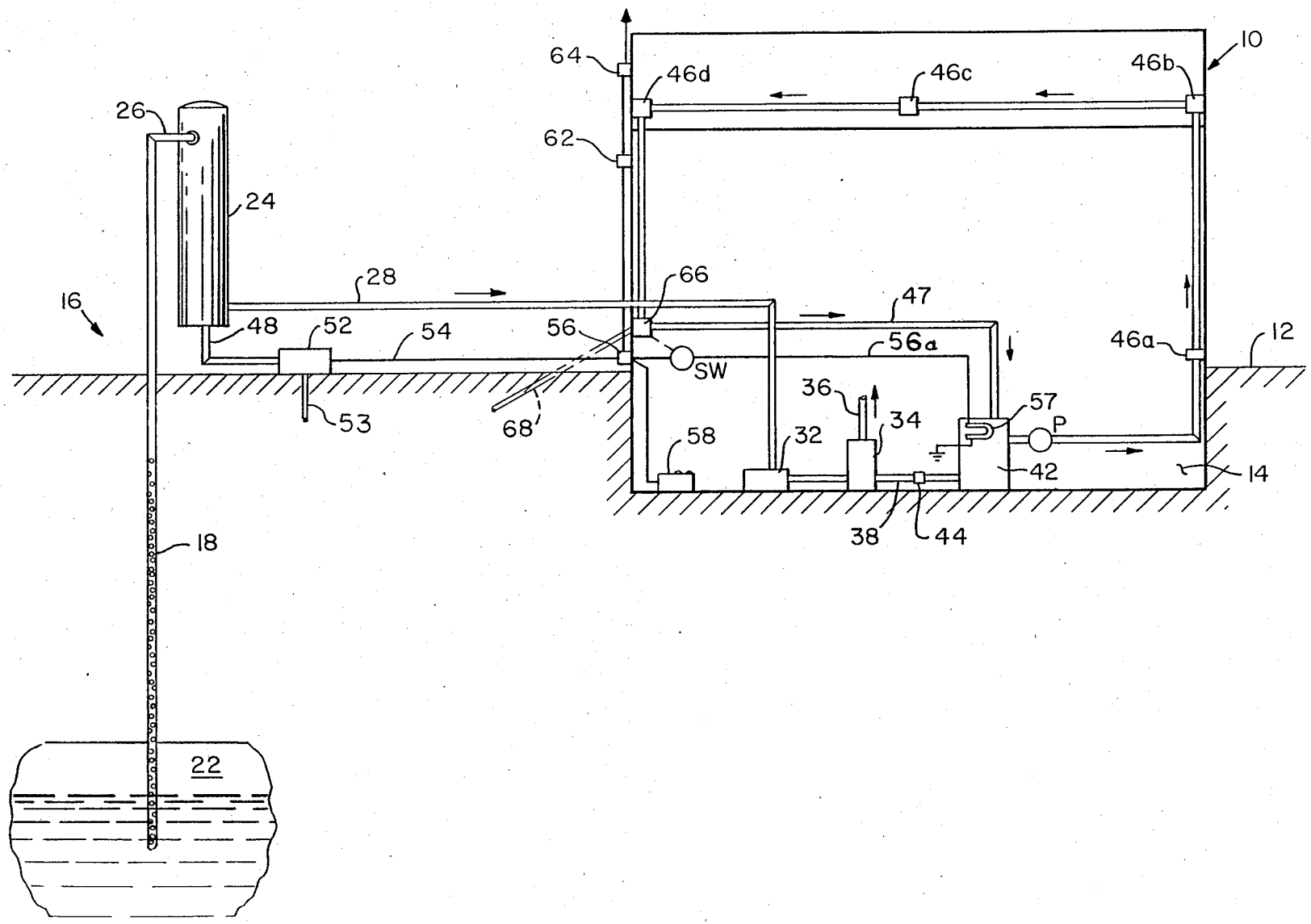
10
12
14
46b
46a
57
P
42
46c
47
56a
44
34
38
36
32
46d
66
SW
58
64
62
56
68
54
28
52
53
24
48
18
22
26
16

ARTESIAN WELL GENERATED POWER SYSTEM

BACKGROUND OF THE INVENTION

This invention relates to an artesian well being used to generate electricity on a continuous basis for domestic use. The well water is used for household purposes and during certain seasons the effluent water is recirculated for cooling purposes.

An artesian well is a well in which water, once brought to the surface by conventional means, will continue to flow due to underground pressure. In some locations, artesian wells can be formed by relatively deep vertical bores from which water flow can be obtained at sufficient pressure for the water to rise twenty feet or more above ground level and with a flow rate on a continuous basis of thirty gallons per minute or more.

Some attempts in the past have been made to utilize the pressure of domestic water supplied by a central or municipal water supply authority as shown in U.S. Pat. No. 4,142,367 to Guisti and in other cases by taking excess power to place the water under pressure in underground caverns for later use as in U.S. Pat. No. 3,538,340 to Lang and in U.S. Pat. No. 3,939,356 to Loane. Other patents utilizing fluid under pressure to generate power are U.S. Pat. No. 4,134,024 to Wiseman and U.S. Pat. No. 4,392,062 to Berrig.

None of the above patents relates particularly to the use of artesian wells and only Guisti deals with domestic water supply. In this patent the generation of electricity could interfere with the normal domestic use of the water and generate electricity only when water is being used inside the premises, not continuously. It also lacks provision for adequate storage and application of the effluent water for use in air conditioning of the premises. Guisti's system relies on the usage of water in the premises to produce electricity and requires the purchase of water from a utility to produce the electric current.

SUMMARY OF THE PRESENT INVENTION

In the present invention, a power generation system uniquely coupled to an artesian well for domestic household use is provided in which electricity is produced for use in the home and/or return to the electric utility, the effluent water being utilized to provide cooling of the premises when conditions require. An electric heater coil placed in the boiler thermostatically controlled runs on generated electricity for home heating.

In accordance with a preferred embodiment of this invention there is provided an energy supply system for a building comprising an artesian well for supplying water under natural pressure at a constant flow and an above ground tank to receive water from the well on a continuous basis. Water is drawn from the tank by a first pipe which supplies both the normal domestic needs of the building and a closed hot water circulating system which would include a boiler equipped with an electric heating coil, convectors, a circulating pump, and pipes interconnecting the various elements. A second pipe draws water from the tank at a sufficient head to drive a turbine actuated AC electric generator. Sufficient AC power is converted to DC to maintain a battery at full charge. The battery acts only as a backup to provide electric power during an emergency. Electric power generated by this system is supplied to a thermostatically controlled heating element in the boiler to provide hot water for heating and domestic use. Any remaining AC power is fed into the utility electric grid through a meter to keep track of this power and obtain credit for the occupants of the building.

In order to cool the building, return water to the boiler in the hot water system is fed directly to the ground so that water at substantially well water temperature (approximately 55° F.) is flowing continuously through the convectors thereby cooling the building.

It is thus a principal object of this invention to provide an electric power generating system relying on water from an artesian well which additionally will provide cooling of the premises during certain times of the year.

Other objects ad advantages of this invention will become obvious from the following description of a preferred embodiment of this invention.

BRIEF DESCRIPTION OF THE DRAWING

The FIGURE shows schematically a preferred embodiment of this invention.

DETAILED DESCRIPTION OF THE PREFERRED EMBODIMENT

Referring to the FIGURE there is illustrated a building 10 which typically would be a household residence or dwelling located at ground level 12 having a below ground basement 14.

Adjacent building 10 is an artesian well 16 consisting of a pipe 18 extending down into a region 22 where there is a supply of water of sufficient pressure and flow capacity to meet the requirements of this invention.

Pipe 18 terminates above ground level 12 at a point approximately the height of building 10, typically twenty feet or more above ground level 12.

A vertical storage tank 24 is located adjacent pipe 18, but, depending on climatic conditions, tank 24 may be located within building 10, or, in certain conditions, well 16 may extend down through the basement 14 of building 10 so that the entire system including the artesian well can be protected from the weather elements. A transfer pipe 26 carries continuously water from artesian well 16 into storage tank 24. The exact height and diameter of tank 24 would be determined by any applicable zoning regulations and head pressure desired.

A pipe 28 connected to storage tank 24 carries away water to be employed for the normal domestic supply needs of building 10. If an increase in pressure in the domestic water supply is desired, pipe 28 may carry this water to the suction side of a pump 32 for delivering the water to a pressurized tank 34 which supplies the aforementioned domestic water supply by way of a pipe 36 and a pipe 38 to boiler 42 of a conventional hot water circulation system for heating building 10. Pipe 36 would supply cold water for direct use and for heating in a hot water tank (not shown). A check valve 44 permits make-up water to enter boiler 42 as is understood in the art. As shown by the arrows, the hot water driven by pump P circulates through convectors **46*a*, 46*b*, 46*c*, and 46*d* such as baseboard heaters distributed throughout building 10 and return line 47 to boiler 42**.

At the bottom of tank 24, to obtain maximum head, a pipe 48 delivers water under pressure to a turbo-generator 52. The latter consists of a turbine such as a pelton impulse type wheel and an electric AC/DC generator. A proper jet configuration of pipe 48 entering unit 52 would be employed. The electricity generated within unit 52 is delivered by conductor 54 to DC-to-AC electric converter 56 and battery unit 58. Unit 58 would incorporate the usual voltage regulator apparatus as is commonly in use to prevent overcharging of the battery. Effluent water from unit 52 would be discharged to ground through pipe 53.

Electric power from unit 56 supplies electricity by way of circuit line 56*a* to coil 57 within boiler 42 thereby reducing the load on the fuel required to heat the water within boiler 42.

Electric generating systems of the type referred to above for turbo-generator 52 are commercially available such as, for example, pelton systems manufactured and sold by Canyon Industries, Inc. of Deming, Washington.

Connected also to converter 56 is a unit 62 designed to feed to the electric utility any excess AC power not needed for domestic use, through a meter 64 for keeping track of said power. Unit 62 may consist of a synchronous inverter connected to a meter for incoming utility and outgoing excess generated power along with an automatic load transfer control box. Such a synchronous inverter is described in "Harnessing Water Power for Home Energy" by Dermot-McGuigan, published 1978 by Garden Way Associates, Inc., while a load transfer control box is described in "Electric Generating Systems" by L. J. Mages published 1970 by Howard W. Sams & Co.

When peak loads of electricity are required, the supply from the utility is relied upon and as these peaks diminish there is a continued supply of electricity fed back to the utility.

In addition, as the typical temperature of water supplied by a deep well is about 55° F. provision is made to use said water in the convection units 46*a*–46*d* to cool the interior of building 10 when the temperature within rises to some uncomfortable value such as 80° F. which is likely to occur during certain times of the year depending on local climatic conditions.

To accomplish such cooling, there is provided a two-way valve 66 in the hot water return line 47 from convector 46*d* to boiler 42. When cooling is required, valve 66 is turned to a position where the water leaving convector 46*d* is not returned to boiler 42 but is fed to a line 68 which returns the water to the ground. Thus, check valve 44 would automatically be continuously open feeding cold water through the piping system connecting boiler 42 to convectors 46*a*, 46*b*, 46*c*, and 46*d*.

In the operation of the system just described, the position of valve 66 would be determined by whether cooling is required. If cooling is not required, then it would be positioned to return the water from convector 46*d* to boiler 42 whose own thermostatically controlled heating and cirulating system as is established in the art would provide whatever heat may be required in building 10.

When cooling is required, valve 66 would be adjusted to direct flow to pipe 68 for return of the water to the ground. It is understood, while not shown, that a thermostat may be employed to control the rate of flow of water during cooling such as a suitable thermostatically controlled flow valve in line 68. A switch SW in line 56*a* carrying electricity to coil 57 in boiler would be opened when valve is in its cooling position thereby preventing coil 57 from receiving electric power.

As earlier mentioned, building 10 would normally rely on electricity generated by the water in tank 24, and when demand cannot be met by generator 52, there would be drawn from the electric utility the additional electric power required. When demand lessens to the point where all of the generated electricity cannot be utilized then electric power would be fed back into the lines of the utility with the resident receiving credit for that power.

The system just described provides for substantial energy conservation in locations where there is an adequate supply of water from artesian wells. There are many locations throughout this country where such artesian wells can be drilled, and this system makes it possible to use such wells efficiently and effectively to reduce the need for an external source of electricity.

While only a preferred embodiment of this invention has been described it is understood that many variations are possible without departing from the principles of this invention as defined in the claims which follow.

What is claimed is:

1. An energy supply system for a building having an outside source of AC electricity comprising:

a. an artesian well for supplying water under pressure;

b. a storage tank above ground level for receiving water from said well continuously;

c. first means for drawing water from said tank for supplying both the normal domestic needs of said building and a closed hot water circulating system, the latter comprising a boiler, electric heating element, a series of convectors, and piping means for supplying said convectors with hot water from said boiler and returning said water to said boiler;

d. second means for drawing water from said tank for generating electricity from the head of said water in said tank;

e. battery means being charged by electricity from said generating means for providing emergency electric power in said building;

f. means for utilizing generated electricity to energize said heating element in said boiler when required and returning any excess electricity to said outside source; and g. means to bypass said boiler with the return water from said convectors when cooling is required in said building so that water at substantially well water temperature is flowing continuously through said convectors for cooling the building.

2. The energy supply system of claim 1 in which said bypass means comprises a valve for either directing return water to said boiler or to the ground.

3. The energy supply system of claim 2 having means in response to the position of said valve directing return water to ground to block electric power flow to said coil when said bypass means effectuates cooling.

* * * * *